US007029379B2

(12) United States Patent
Jimbo et al.

(10) Patent No.: US 7,029,379 B2
(45) Date of Patent: Apr. 18, 2006

(54) WAFER HOLDING PLATE FOR WAFER GRINDING APPARATUS AND METHOD FOR MANUFACTURING THE SAME

(75) Inventors: Naoyuki Jimbo, Gifu-ken (JP); Yuji Okuda, Gifu-ken (JP); Shigeharu Ishikawa, Gifu-ken (JP); Atsushi Mishima, Gifu-ken (JP)

(73) Assignee: Ibiden Co., Ltd., (JP)

( * ) Notice: Subject to any disclaimer, the term of this patent is extended or adjusted under 35 U.S.C. 154(b) by 0 days.

(21) Appl. No.: 11/175,745

(22) Filed: Jul. 6, 2005

(65) Prior Publication Data

US 2005/0245177 A1 Nov. 3, 2005

Related U.S. Application Data

(62) Division of application No. 10/236,395, filed on Sep. 5, 2002, now Pat. No. 6,916,228, which is a division of application No. 09/532,532, filed on Mar. 21, 2000, now Pat. No. 6,475,068.

(30) Foreign Application Priority Data

Mar. 26, 1999 (JP) ..... 11-083830
Mar. 26, 1999 (JP) ..... 11-083831

(51) Int. Cl.
*B24B 1/00* (2006.01)

(52) U.S. Cl. ..... 451/57; 451/41; 451/285; 451/398

(58) Field of Classification Search ..... 451/41, 451/57, 285–290, 397, 398
See application file for complete search history.

(56) References Cited

U.S. PATENT DOCUMENTS

| | | | | |
|---|---|---|---|---|
| 5,423,716 | A * | 6/1995 | Strasbaugh | 451/388 |
| 5,616,212 | A | 4/1997 | Isobe | |
| 5,651,724 | A * | 7/1997 | Kimura et al. | 451/41 |
| 5,769,692 | A | 6/1998 | Pasch et al. | |
| 5,792,709 | A | 8/1998 | Robinson et al. | |
| 5,797,789 | A * | 8/1998 | Tanaka et al. | 451/289 |
| 5,951,374 | A * | 9/1999 | Kato et al. | 451/41 |
| 6,112,740 | A * | 9/2000 | Wark et al. | 125/35 |

FOREIGN PATENT DOCUMENTS

| | | |
|---|---|---|
| EP | 0786 803 A1 | 7/1997 |
| EP | 0887152 | 12/1998 |
| EP | 1 020 253 A2 | 7/2000 |
| JP | 04115865 | 4/1992 |

OTHER PUBLICATIONS

European Search Report Dated Oct. 2, 2003.

* cited by examiner

*Primary Examiner*—Lee D. Wilson
*Assistant Examiner*—Anthony Ojini
(74) *Attorney, Agent, or Firm*—Traskbritt, P.C.

(57) ABSTRACT

A method for manufacturing a wafer holding plate for a wafer grinding apparatus wherein the plate includes a substrate having a wafer adhering surface to which a semiconductor wafer is adhered by an adhesive. The wafer adhering surface includes a mirror-like surface portion and a groove pattern, which anchors the adhesive. When the plate is used for grinding wafers, the quality and accuracy of the finished wafers is greatly improved.

12 Claims, 7 Drawing Sheets

WAFER HOLDING PLATE FOR WAFER GRINDING APPARATUS AND METHOD FOR MANUFACTURING THE SAME

CROSS-REFERENCE TO RELATED APPLICATION

This application is a divisional application of application Ser. No. 10/236,395, filed Sep. 5, 2002 now U.S. Pat. No. 6,916,228, pending, which is a divisional application of application Ser. No. 09/532,532, filed Mar. 21, 2000, now U.S. Pat. No. 6,475,068, issued on Nov. 5, 2002

BACKGROUND OF THE INVENTION

1. Field of the Invention

The present invention relates to a wafer holding plate used for wafer grinding apparatuses and a method for manufacturing the same.

2. State of the Art

Apparatuses for grinding the surface of a semiconductor wafer, such as a lapping machine or a polishing machine, are known in the prior art. A typical wafer grinding apparatus includes a table, which is fixed to a cooling jacket, and a wafer holding plate. The plate has a wafer adhering surface to which an adhesive, such as a thermoplastic wax, is applied. The adhesive attaches a semiconductor wafer to the plate.

Since the wafer adhering surface is flat, the adhesive must be relatively thick to ensure adhesion of the semiconductor wafer. It is difficult to apply the adhesive uniformly. As a result, parallelism between the wafer adhering surface and the semiconductor wafer is not achieved, which causes the semiconductor wafer to be held obliquely. Therefore, it is difficult to achieve highly accurate grinding.

Furthermore, if the surface of the plate is rough, the lands and pits of the plate surface are transferred to the rear surface of the wafer (the surface adhered to the plate) when the plate holding the wafer is pressed against a grinding surface. This decreases the accuracy and quality of the semiconductor wafer. Additionally, production efficiency decreases because wafers have to be reground to correct dimensions.

BRIEF SUMMARY OF THE INVENTION

It is an object of the present invention to provide a wafer holding plate for a wafer grinding apparatus that can manufacture a semiconductor wafer with high accuracy and high quality.

To achieve the above object, the present invention provides a wafer holding plate used in a wafer grinding apparatus. The plate includes a substrate having a wafer adhering surface to which a semiconductor wafer is adhered by an adhesive. The wafer adhering surface includes a mirror-like surface in which a groove pattern is formed.

A further aspect of the present invention provides a wafer holding plate used in a wafer grinding apparatus. The plate includes a substrate having a wafer adhering surface to which a semiconductor wafer is adhered by an adhesive. The wafer adhering surface includes a groove pattern. The groove pattern includes grooves having curved edges.

Another aspect of the present invention provides a method for manufacturing a wafer holding plate used in a wafer grinding apparatus. The method includes grinding a surface of a substrate to which a semiconductor wafer is adhered by an adhesive, masking the ground surface with a predetermined pattern, and blasting the wafer adhering surface with particles to form a groove pattern.

A further aspect of the present invention provides a method for manufacturing a wafer holding plate used in a wafer grinding apparatus. The method includes blasting a wafer adhering surface of a substrate with particles to form grooves and to simultaneously round edges of the grooves. A semiconductor wafer is adhered to the completed wafer adhering surface with adhesive.

Other aspects and advantages of the present invention will become apparent from the following description, taken in conjunction with the accompanying drawings, illustrating by way of example the principles of the invention.

BRIEF DESCRIPTION OF THE SEVERAL VIEWS OF THE DRAWINGS

The invention, together with objects and advantages thereof, may best be understood by reference to the following description of the presently preferred embodiments together with the accompanying drawings in which.

DETAILED DESCRIPTION OF THE INVENTION

Figure 1:
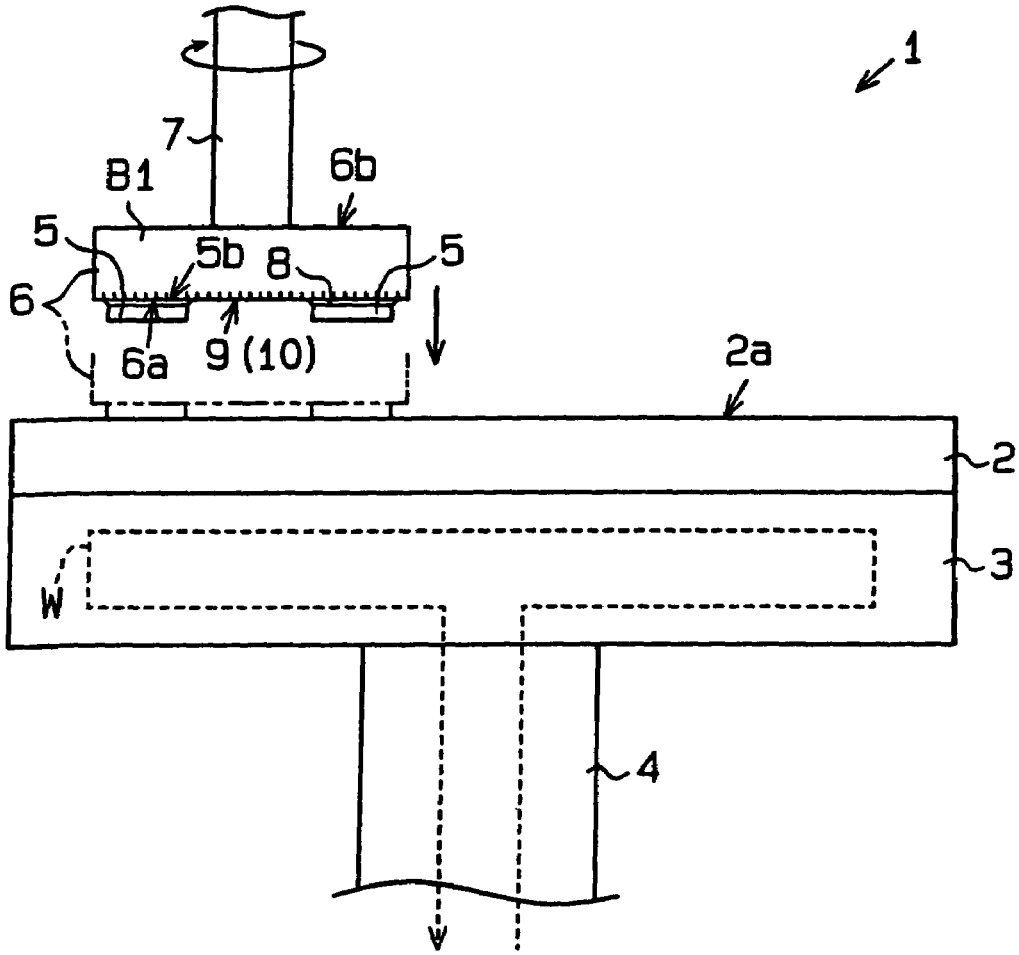
FIG. 1 is a schematic diagram showing a wafer grinding apparatus according to a first embodiment of the present invention.

In the drawings, like numerals are used for like elements throughout.

FIG. 1 is a schematic view showing a wafer grinding apparatus 1 according to a first embodiment of the present invention. The wafer grinding apparatus 1 is a lapping machine for grinding a wafer slice. The wafer was sliced during a bare wafer process. Further, the wafer grinding apparatus 1 includes a round metal table 2, which is preferably made of stainless steel or the like. Table 2 has an upper surface, or grinding surface 2*a*, on which the semiconductor wafer 5 is ground. A grinding cloth (not shown) is adhered to the grinding surface 2*a*. Table 2 is fastened to a round cooling jacket 3 by bolts (not shown). The cooling jacket 3 is supported horizontally by a cylindrical rotary shaft 4. Coolant W circulates through a flow passage extending through the interior of the cooling jacket 3.

The wafer grinding apparatus 1 has a plurality of (e.g., two) wafer holding plates 6 (also known as pusher plates, only one shown). Each of the wafer holding plates 6 is formed from a circular substrate B1. The substrate B1 has an upper surface 6*b*, the center of which is fixed to a pusher rod 7 of a drive apparatus (not shown)—A wafer adhering surface 6*a* is on the opposite, lower side of the substrate B1 and faces the grinding surface 2*a* of table 2. The pusher rod 7 supports the wafer holding plate 6 so that the wafer adhering surface 6*a* is parallel to the grinding surface 2*a*. Each pusher rod 7 rotates integrally with the associated plate 6 and moves vertically within a predetermined range. A plurality of semiconductor wafers 5 are adhered to the wafer adhering surface 6*a* of the plate 6 by a thermoplastic wax 8. The front surface of each wafer 5 faces the grinding surface 2*a*. The wafer grinding apparatus 1 presses the plate 6 against the grinding surface 2*a* with a predetermined force so that the wafers 5 contact the grinding surface 2*a*.

It is preferred that the wafer holding plates 6 be formed from a sintered ceramic body. Further, it is preferred that the sintered ceramic body have a high density and be made of a material such as sintered ceramic silicide or sintered ceramic carbide. In the first embodiment, the wafer holding plates 6 are formed from a sintered silicon carbide (SiC) body.

The preferred density of the sintered ceramic body is 2.7 g/cm$^3$ or higher. It is more preferred that the density be 3.0 g/cm$^3$ or higher and most preferred that the density be 3.1 g/cm$^3$ or higher. This is because the thermal conductivity increases when the density of the sintered body increases.

The preferred thermal conductivity is 30 W/mK or higher. It is more preferred that the thermal conductivity be within the range of 80 W/mK to 200 W/mK. If the thermal conductivity is too low, it is difficult to keep the temperature of the sintered body uniform. A non-uniform temperature limits accuracy and quality and hinders manufacture of semiconductor wafers 5 that have a large diameter. On the other hand, it is difficult to find stable, inexpensive materials that have a thermal conductivity higher than 200 W/mK.

Figure 2:
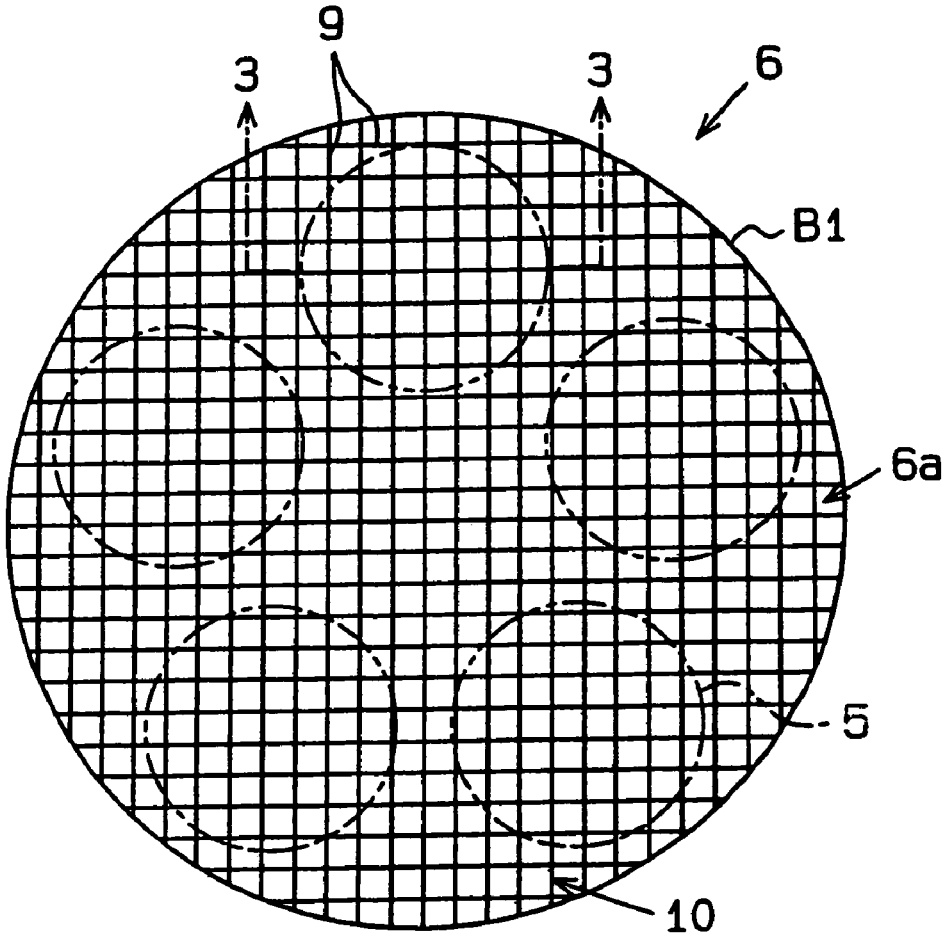
FIG. 2 is a schematic plan view showing a wafer holding plate of the apparatus of FIG. 1.
Figure 3:
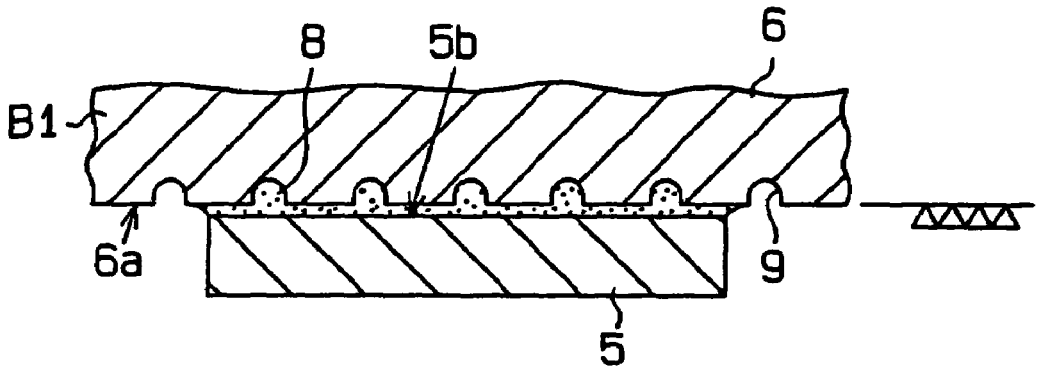
FIG. 3 is a schematic cross-sectional view taken along line 3—3 in FIG. 2.

With reference to FIGS. 2 and 3, the wafer adhering surface 6*a* is a mirror-like surface having a surface roughness Ra of 0.1 μm or less. An anchoring groove pattern 10 is formed in the wafer adhering surface 6*a*. The anchoring groove pattern 10 includes a plurality of straight grooves 9. The grooves 9 are equally spaced from one another and arranged in a grid-like manner. In other words, the groove pattern 10 is formed by intersecting a plurality of the grooves 9 with each other. It is preferred that the grooves 9 occupy about 1% to 50% of the wafer adhering surface 6*a*. It is further preferred that the grooves 9 occupy about 1% to 20% of the adhering surface 6*a*.

It is preferred that the width of the grooves be about 50 μm to 500 μm. If the width is less than 50 μm, the wax 8 cannot be properly anchored to the adhering surface 6*a*. This makes it difficult to apply the wax 8 uniformly, which in turn, makes it difficult to improve wafer parallelism. On the other hand, if the width exceeds 500 μm, the pits and lands formed by the grooves 9 may be transferred to the wafers 5 and affect the quality of the wafers 5.

It is preferred that the grooves 9 have a depth of about 20 μm to 100 μm. If the depth of the grooves 9 is less than 20 μm, the grooves 9 may not properly function as anchors. On the other hand, if the depth of the grooves 9 exceeds 100 μm, pits and lands formed by the grooves 9 may be transferred to the wafers 5.

A method for manufacturing the plates 6 will now be described.

A plate-like substrate B1 is first prepared. The preferred embodiment uses "SC-850" which is a dense sintered silicon carbide body produced by IBIDEN KABUSHIKI KAISHA. The sintered body has a density of 3.1 g/cm$^3$ and a thermal conductivity of 150 W/mK. The substrate B1 may be formed from a dense sintered ceramic body produced through a normal procedure during which a ceramic raw material forming step, a molding step, and a baking step are sequentially performed.

The wafer adhering surface 6*a* of the substrate B1 is then ground to obtain a mirror-like surface, the surface roughness Ra of which is 0.1 μm or less. The surface grinding is performed by using a hard silicon carbide grinding fixture.

After the grinding process, the wafer adhering surface 6*a* is sandblasted. A mask 11 is used in the sandblasting to form the grooves 9. The sandblasting process will now be discussed with reference to FIGS. 4(*a*) to 4(*c*).

Before performing the sandblasting process, the mask 11, which is grid-like to conform to the groove pattern 10, is applied to the wafer adhering surface 6*a*. The mask 11 exposes the locations of the grooves 9 to abrasive grains 14 and protects other parts of the wafer adhering surface 6*a* from the abrasive grains 14.

When a direct printing method is employed to form the mask 11, a photosensitive resin R1 is uniformly applied to the substrate B1. Ultraviolet rays are then irradiated toward the photosensitive resin R1 through a photomask 12 to selectively expose portions corresponding to the grooves 9 to the ultraviolet rays (FIG. 4(*a*)). A urethane or acrylic resin having photosensitivity may be used as the photosensitive resin R1. Subsequently, the photosensitive resin R1 is developed, washed, and dried. Afterward, the unexposed portions of the photosensitive resin R1 are removed to form slits 13 (FIG. 4(*b*)).

When an indirect printing method is employed to form the mask 11, a film mask 11 having the slits 13 is positioned on and adhered to the wafer adhering surface 6*a* of the substrate B1. Regardless of the printing method, the mask 11 is required to have a thickness that can resist sandblasting. More specifically, it is preferred that the mask 11 have a thickness of 50 μm to 300 μm.

Figure 4A:
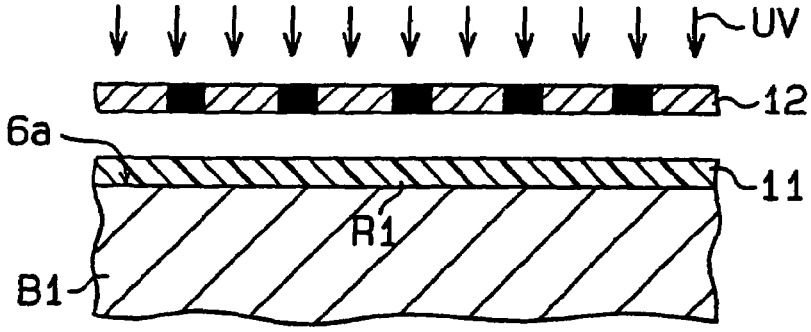
FIGS. 4(*a*) to 4(*c*) are schematic cross-sectional views illustrating the procedures for manufacturing the plate of FIG. 2.
Figure 4B:
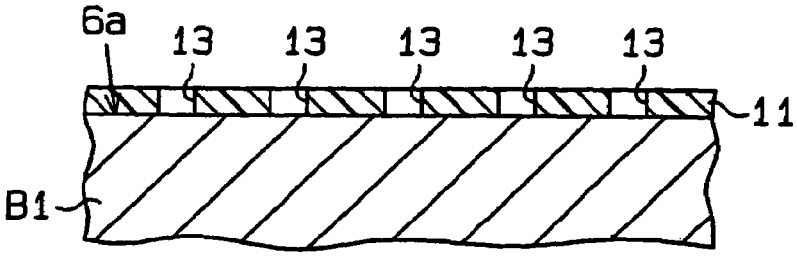
Figure 4C:
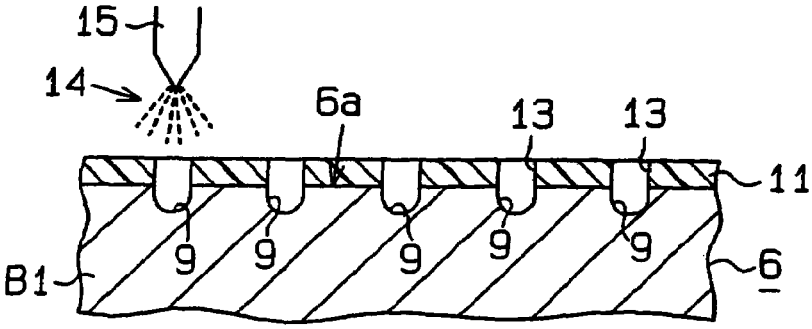
Figure 6A:
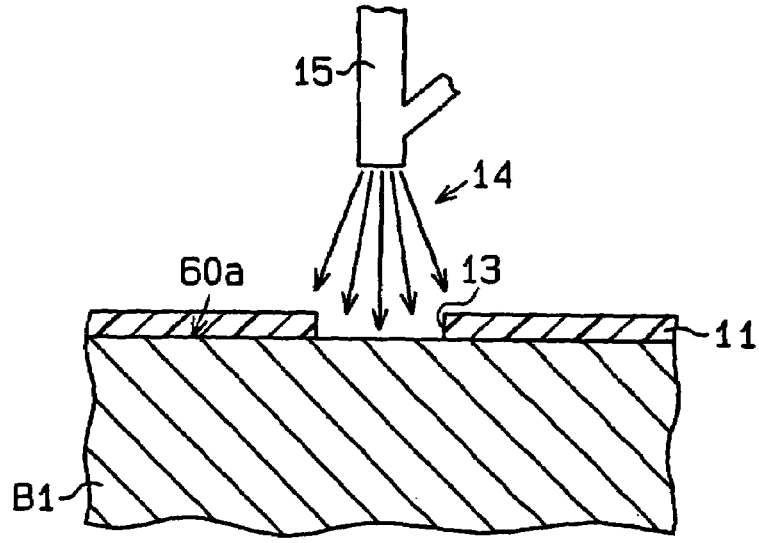
FIGS. 6(*a*) to 6(*d*) are schematic cross-sectional views illustrating the procedures for manufacturing the plate of FIG. 5.
Figure 6B:
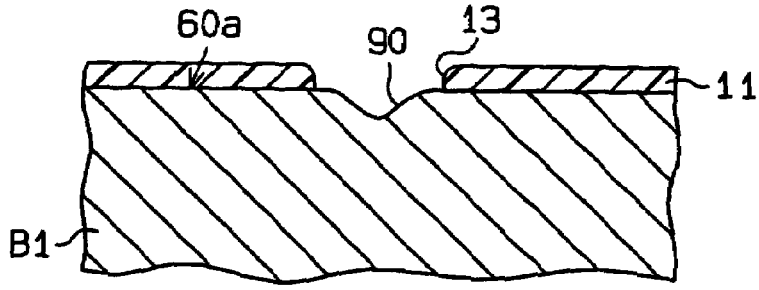
Figure 6C:
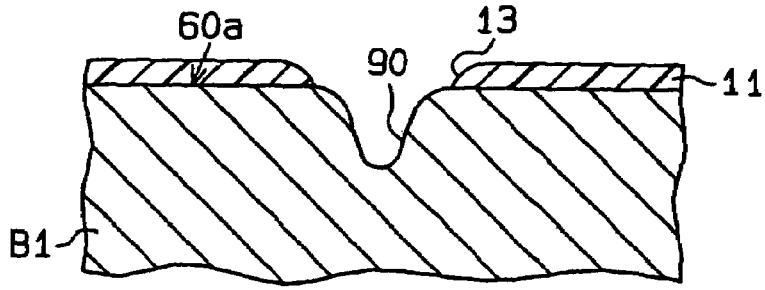
Figure 6D:
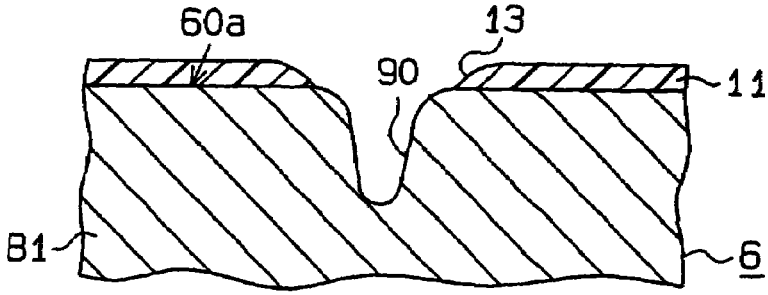

During the sandblasting process, the abrasive grains 14 are blasted against the substrate B1 from a nozzle 15 (FIG. 4(*c*)).

The conditions required for the sandblasting process will now be discussed.

1) Type of the abrasive grains 14: GC (can be altered to C, WA, or A)
2) Size of the abrasive grains 14: #180 to #1000 (selected from this range in accordance with the width and depth of the grooves 9)
3) Blasting pressure: 3.0 kg/cm$^2$ to 5.0 kg/cm$^2$
4) Distance between the nozzle 15 and the mask: 20 mm to 150 mm The blasted abrasive grains 14 etch the wafer adhering surface 6*a* and form the grooves 9, which have the predetermined width and depth at positions corresponding to the slits 13. After the sandblasting process, the mask 11 is removed and the wafer holding plate 6 is completed.

The advantages of the first embodiment will now be discussed.

(1) The wafer holding plate 6 is provided with the anchoring groove pattern 10 formed on the wafer adhering surface 6*a*. The groove pattern 10 functions as an anchor that causes the wax 8 to adhere the plate 6. This enables application of a thin, uniform layer of the wax 8 and improves the parallelism of the wafers 5. This produces high-quality, accurate semiconductor wafers 5. Further, the adhesiveness of the wax 8 does not decrease. This prevents various sizes of the semiconductor wafers 5 from being displaced or from falling off from the wafer holding plate 6 after the wafers 5 are ground.

The portions of the wafer adhering surface 6*a* between the grooves 9 are mirror-like and finished to have a surface roughness Ra of 0.1 μm. These portions do not transfer land and pits to the rear surface 5*b* of the wafers 5. Accordingly, corrections made to eliminate such transferred lands and pits are not required. This improves the manufacturing efficiency.

(2) The density of the substrate B1 of each wafer holding plate 6 is 2.7 g/cm$^3$ or more, and the substrate B1 is a dense sintered ceramic body having a thermal conductivity of 30 W/mK or more. Accordingly, the binding between crystal grains is strong and the number of pores is relatively low in the wafer holding plates 6. Further, the wafer holding plates 6 are very corrosion-resistant. The dense sintered silicon carbide substrate B1 has high rigidity, a low coefficient of thermal expansion, and a high coefficient of thermal conductivity. Further, the wafer holding plates 6 resist thermal deformation and thermal shocks. Accordingly, the employment of the wafer holding plates 6 produces semiconductor wafers 5 with higher accuracy and quality. Further, wafers having larger diameters can be processed.

(3) The grooves 9 of the groove pattern 10 have a width of 50 μm to 200 μm and a depth of 20 μm to 100 μm. This maximizes the anchoring effect of the groove pattern 10 and thus increases the accuracy and quality of the semiconductor wafers 5.

(4) When manufacturing the wafer holding plates 6, after grinding, the wafer adhering surface 6*a* is blasted process with the mask 11 in place. The grinding reduces the surface roughness Ra of the wafer adhering surface 6*a*. The mask 11 blocks certain areas of the substrate B1 and forms a plurality of the narrow grooves 9 in an accurate and inexpensive manner. Further, the mask 11 protects the ground wafer adhering surface 6*a* from the abrasive grains 14. Thus, the surface roughness Ra of the areas other than the grooves 9 is unchanged by the sandblasting. Accordingly, the plates 6 are formed inexpensively and accurately.

(5) The sandblasting process is employed to form the groove pattern 10. Therefore, a rotating tool such as a grindstone is not needed and the problems associated with such tools do not occur. By using the abrasive grains 14, which are far smaller than a grindstone, the narrow grooves 9 are formed relatively easily without increasing costs. Accordingly, the plates 6 can be manufactured in an inexpensive manner regardless of the size, shape, and number of the grooves formed on the wafer adhering surfaces 6*a*. Sandblasting is very effective when working with hard materials such as the substrate B1.

Figure 5:
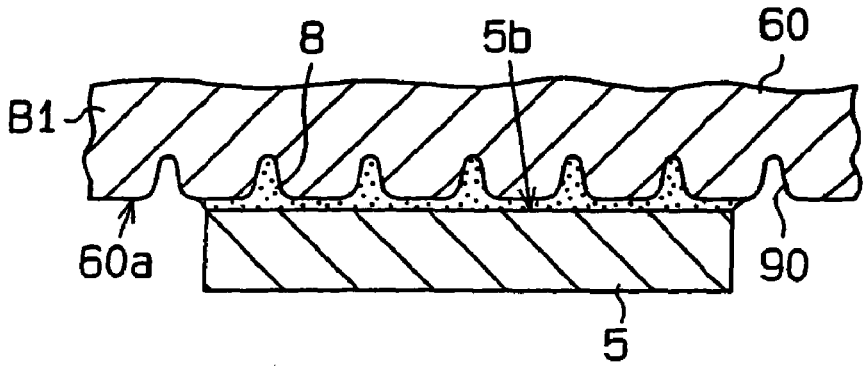
FIG. 5 is a schematic cross-sectional view showing a wafer holding plate according to a second embodiment of the present invention.

FIG. 5 is a cross-sectional view showing a wafer holding plate 60 according to a second embodiment of the present invention. The wafer holding plate 60 includes a substrate B1 having a mirror-like surface 60*a*. An anchoring groove pattern 10 is formed in the mirror-like surface 60*a*. The anchoring groove pattern 10 includes a plurality of generally V-shaped grooves 90. As shown in FIGS. 5 and 6(*d*), the edges of the grooves 90 are curved. That is, the edges of the grooves 90 are not squared. Further, the grooves 90 each have a rounded bottom surface. In other words, the edges and the walls of each groove do not have angled surfaces where internal stress would concentrate.

With reference to FIGS. 6(*a*) to 6(*d*), the grooves 90 are formed by applying the mask 11 to the substrate B1 and sandblasting abrasive grains 14 from the nozzle 15 against the substrate B1. In this process, the amount of abrasive grains 14 blasted against a first portion of the substrate B1, which is located directly below the nozzle 15, is greater than that blasted against the portions adjacent to the first portion, or a second portion of the substrate B2. Accordingly, the first portion is etched at a faster speed than the second portion. Thus, the bottom of each groove 90 is formed at the location corresponding to the first portion as shown in FIG. 6(*d*). The abrasive grains 14 form edges that are curved and not squared. In other words, when the wafer adhering surface 6*a* is sandblasted, formation of the grooves 90 and the rounding of the groove edges are performed simultaneously.

In the second embodiment, the edges of the grooves 90 in the groove pattern 10 of each wafer holding plate 60 are rounded. Since the grooves 90 do not have squared edges, the groove edges are less likely to break. Accordingly, there are no places where particles are likely to break apart from the grooves 10. Therefore, lands and pits are not transferred to the wafers 5. Thus, the wafers 5 are neither scratched nor damaged. Since correction of transferred lands and pits is not needed, the manufacturing efficiency is improved.

Additionally, in the second embodiment, the formation and rounding of the grooves 90 are performed simultaneously. Accordingly, the grooves 90 having curved edges are formed within a short period of time. The plates 6 are thus formed inexpensively and efficiently.

It should be apparent to those skilled in the art that the present invention may be embodied in many other specific forms without departing from the spirit or scope of the invention. Particularly, it should be understood that the present invention may be embodied in the following forms.

Figure 7:
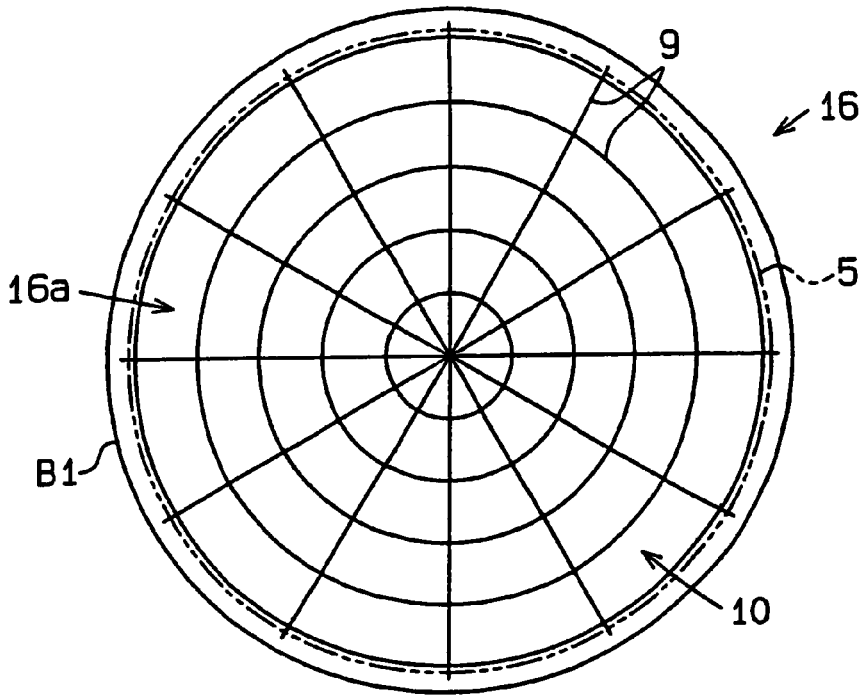
FIG. 7 is a schematic cross-sectional view showing a wafer holding plate according to a third embodiment of the present invention.

(1) The groove pattern 10 formed on the substrate B1 does not necessarily have to be grid-like. For example, the groove pattern 10 may be generally web-like, as shown in FIG. 7. The groove pattern 10 of FIG. 7 includes a plurality of concentric, circular grooves 9 and a plurality of radially extending grooves 9.

Figure 8:
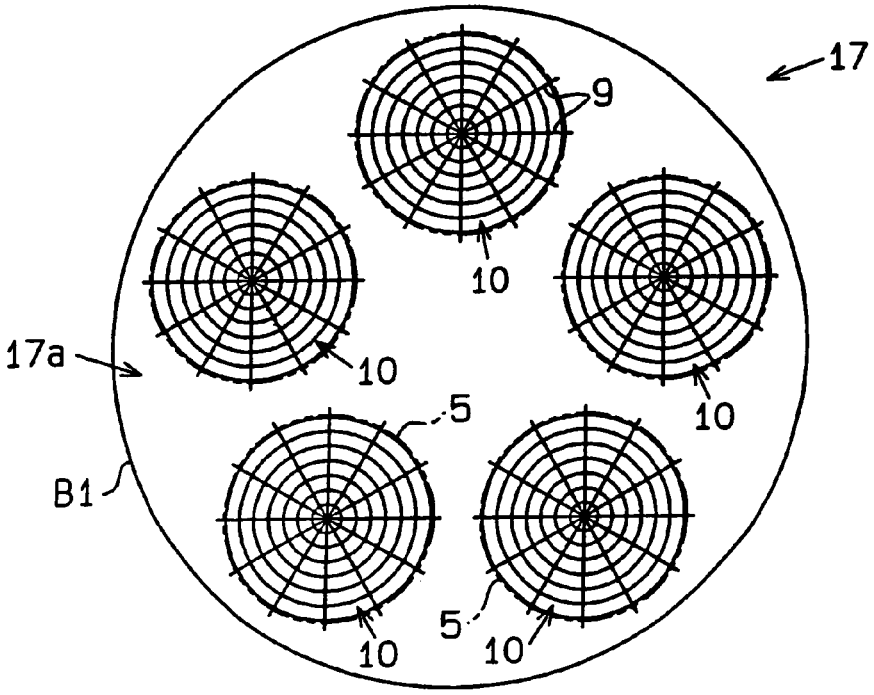
FIG. 8 is a schematic cross-sectional view showing a wafer holding plate according to a fourth embodiment of the present invention.

As shown in FIG. 8, a plurality (e.g., five) of the web-like groove patterns 10 may be formed on the wafer adhering surface 17*a* of the wafer holding plate 17. The size of each groove pattern 10 is substantially the same as the outer dimensions of the semiconductor wafer 5 held on the pattern 10.

(2) Other than the grid-like or web-like patterns, the groove pattern 10 may take any form that has a plurality of intersections. The groove pattern 10 may also be formed without intersections.

(3) In addition to silicon carbide, silicon nitride ($Si_3N_4$) or sialon may be used for the sintered ceramic silicide body from which the substrate B1 is formed. In this case, it is preferred that a body having a density of 2.7 g/cm$^3$ be used.

(4) In addition to silicon carbide, boron carbide ($B_4C$) may be used for the sintered ceramic carbide body from which the substrate B1 is formed. In this case, it is preferred that a body having a density of 2.7 g/cm$^3$ be used.

(5) The substrate B1 may be formed from a material other than a sintered ceramic such as metal.

(6) The grooves 9 may be formed through processes other than sandblasting. For example, the grooves 9 may be formed through a dry blasting process, such as shot blasting, or through a wet blasting process, such as liquid honing.

(7) During manufacture of the plates 6, the blasting process may be performed to form the grooves before grinding the wafer adhering surface 6*a*.

(8) In the illustrated embodiments, the wafer holding plate 6 is applied to a pusher plate of a lapping machine. However, the wafer holding plate 6 may also be applied to a polishing plate of a polishing machine.

Figure 9A:
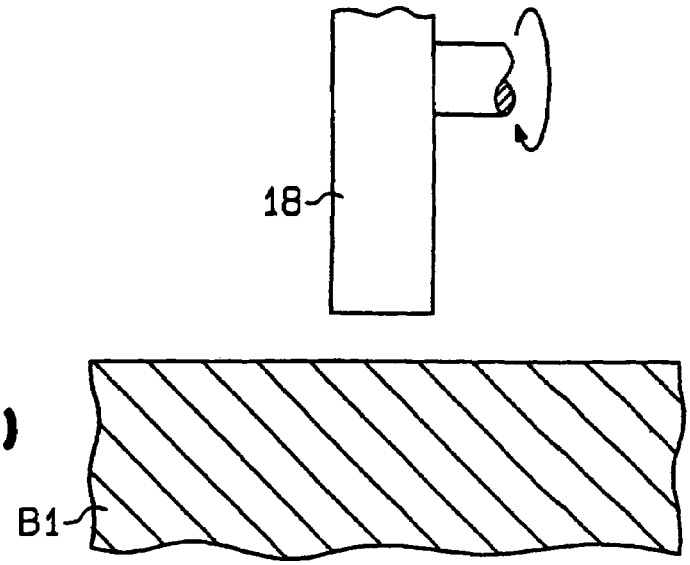
FIGS. 9(*a*) to 9(*c*) are schematic cross-sectional views showing the procedures for manufacturing the plate of FIG. 5 in a further embodiment according to the present invention.
Figure 9B:
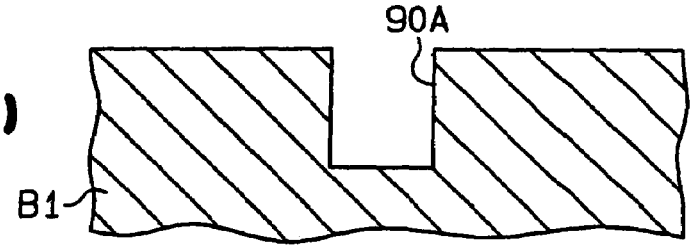
Figure 9C:
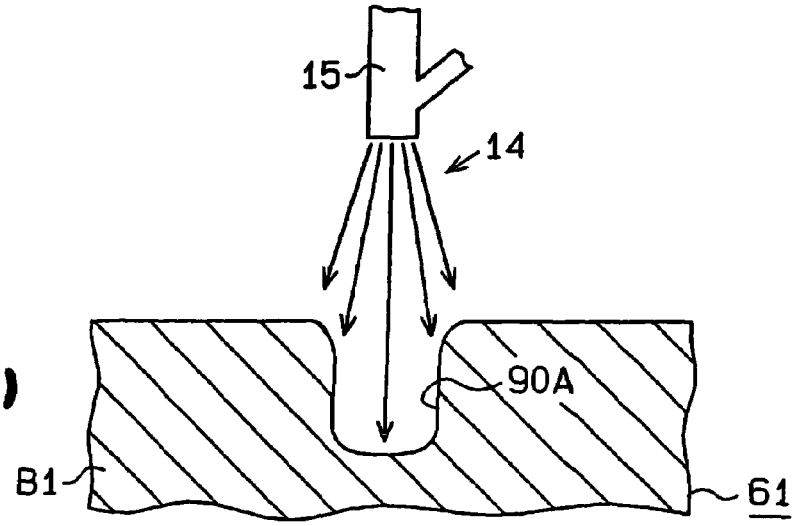

(9) With reference to FIGS. 9(*a*) to 9(*c*), the second embodiment may be modified by separately performing the formation and the rounding of the grooves 90A. The grooves 90A are first ground by a grindstone 18 in the wafer adhering surface 6*a* of the substrate B1. In this state, the grooves 90A have squared edges. The grooves 90A are then sandblasted so that the edges and bottom surface are rounded by abrasive grains. This removes the squared portions formed during grinding. In this case, the sandblasting process may be performed without the mask 11 as shown in FIG. 9(*c*) or with the mask 11 as in the second embodiment.

(10) In the second embodiment, the grooves 90 may be formed so that they have curved edges and flat bottoms.

The present examples and embodiments are to be considered as illustrative and not restrictive, and the invention is not to be limited to the details given herein, but may be modified within the scope and equivalence of the appended claims.

What is claimed is:

1. A method for manufacturing a wafer holding plate used in a wafer grinding apparatus, the method comprising the steps of:

grinding a surface of a substrate to which a semiconductor wafer is adhered by an adhesive;

masking the ground surface with a predetermined pattern; and blasting the wafer adhering surface with particles to form a groove pattern.

2. The method according to claim 1, wherein the blasting includes sandblasting.

3. The method according to claim 2, wherein the substrate is formed from a dense, sintered silicon carbide body, and wherein the sandblasting uses GC type abrasive grains.

4. The method according to claim 3, wherein the masking includes applying a photosensitive resin to the substrate, exposing the resin to light, and developing the resin.

5. The method according to claim 3, wherein the masking includes adhering a patterned film having slits to the substrate.

6. A method for manufacturing a wafer holding plate used in a wafer grinding apparatus, the method comprising a step of blasting a wafer adhering surface of a substrate with particles to form grooves and to simultaneously round edges of the grooves, wherein a semiconductor wafer is adhered to the completed wafer adhering surface with adhesive.

7. The method according to claim 6 wherein the blasting includes sandblasting.

8. The method according to claim 7, wherein the substrate is formed from a dense, sintered silicon carbide body, and wherein the sandblasting uses GC type abrasive grains.

9. The method according to claim 6, wherein the blasting includes blasting abrasive grains from a nozzle against the wafer adhering surface to form a rounded bottom surface for each of the grooves at a first portion located directly below the nozzle and curved edges of each of the grooves at a second portion located adjacent to the first portion.

10. The method according to claim 6 further comprising the step of masking the wafer adhering surface with a predetermined pattern prior to the blasting.

11. The method according to claim 10, wherein the masking includes applying a photosensitive resin to the substrate, exposing the resin to light, and developing the resin.

12. The method according to claim 10, wherein the masking includes adhering a patterned film having slits to the substrate.

* * * * *